US009653787B2

(12) United States Patent
Martinez-Ortigosa et al.

(10) Patent No.: US 9,653,787 B2
(45) Date of Patent: May 16, 2017

(54) ANTENNA SYSTEM FOR A VEHICLE

(71) Applicant: ADVANCED AUTOMOTIVE ANTENNAS, S.L., Barcelona (ES)

(72) Inventors: Enrique Martinez-Ortigosa, Barcelona (ES); Ramiro Quintero-Illera, Barcelona (ES); Laura Tantiña-Cuni, Barcelona (ES); Alfonso Sanz-Arronte, Barcelona (ES); Pere Mogas-Fabre, Barcelona (ES)

(73) Assignee: ADVANCED AUTOMOTIVE ANTENNAS, S.L., Barcelona (ES)

( * ) Notice: Subject to any disclaimer, the term of this patent is extended or adjusted under 35 U.S.C. 154(b) by 273 days.

(21) Appl. No.: 14/449,316

(22) Filed: Aug. 1, 2014

(65) Prior Publication Data

US 2015/0061946 A1 Mar. 5, 2015

(30) Foreign Application Priority Data

Aug. 2, 2013 (EP) ..... 13179099

(51) Int. Cl.
*H01Q 9/28* (2006.01)
*H01Q 1/32* (2006.01)
(Continued)

(52) U.S. Cl.
CPC ..... *H01Q 1/3275* (2013.01); *H01Q 9/0407* (2013.01); *H01Q 9/28* (2013.01);
(Continued)

(58) Field of Classification Search
CPC ..... H01Q 1/3275; H01Q 21/29; H01Q 9/04
(Continued)

(56) References Cited

U.S. PATENT DOCUMENTS

2007/0222682 A1* 9/2007 Tsai ..... H01Q 1/36 343/700 MS
2011/0063181 A1 3/2011 Walker
(Continued)

FOREIGN PATENT DOCUMENTS

EP 1193796 A1 4/2002

OTHER PUBLICATIONS

European Search Report for corresponding application EP13179099 Dated Jan. 7, 2014.

*Primary Examiner* — Dameon E Levi
*Assistant Examiner* — Andrea Lindgren Baltzell
(74) *Attorney, Agent, or Firm* — Cantor Colburn LLP

(57) ABSTRACT

Antenna system for a vehicle including a first directive antenna device and a second antenna device for a frequency band of operation, and a reflector plane, where the first directive antenna device includes a first ground plane, a first dielectric substrate, a first antenna group shorted to the first ground plane and having a first radiating conductor and a second radiating conductor, forming a first configuration and connected to the reflector plane by transmission lines electromagnetically coupled to the frequency band of operation, the reflector plane, disposed forming an angle with respect to the first dielectric substrate, the first directive antenna device radiating in a direction of radiation, and the second antenna device, connected to the first directive antenna device, radiating in an opposing direction to the first directive antenna device.

18 Claims, 12 Drawing Sheets

(51) Int. Cl.
*H01Q 21/29* (2006.01)
*H01Q 25/00* (2006.01)
*H01Q 9/04* (2006.01)

(52) U.S. Cl.
CPC ..... *H01Q 21/29* (2013.01); *H01Q 21/293* (2013.01); *H01Q 25/005* (2013.01)

(58) Field of Classification Search
USPC ..... 343/713
See application file for complete search history.

(56) References Cited

U.S. PATENT DOCUMENTS

2012/0081253 A1* 4/2012 Duzdar ..... H01Q 21/28
343/713
2012/0127053 A1* 5/2012 Noguchi ..... H01Q 3/44
343/833

* cited by examiner

ANTENNA SYSTEM FOR A VEHICLE

CROSS REFERENCE TO RELATED APPLICATION

This application is related to and claims the benefit of European Patent Application Number 13179099.0 filed on 2 Aug. 2013, the contents of which are herein incorporated by reference in their entirety.

TECHNICAL FIELD

The present invention relates to a new design of an antenna system for a vehicle, specifically designed for providing communication between the vehicle and other communication systems, making a preferably use of wireless or satellite communication channels.

An antenna system is provided for a vehicle that assures both forward and backward communication for the vehicle. For that, the antenna system comprises an arrangement formed by two antenna devices, one specifically designed for radiating in a first direction of radiation, and the other, for radiating in a second direction of radiation, being said second direction of radiation an opposing direction to the first direction of radiation.

The antenna system is able to provide an omni-directional coverage, in any type of vehicle on which the antenna system is installed. This is achieved by the combination of the two antenna devices comprised by the antenna system, wherein both antenna devices are suitably designed to provide said omni-directional coverage.

The antenna system is further able to achieve a robust communication, with a decrease in antenna misalignments. This is achieved by the specific design of the antenna system, wherein the beamwidth of its radiation pattern, is fairly wide to reach the system with which it is in communication. At the same time, the antenna system is able to tolerate certain displacements in its emplacement without the communication being affected.

BACKGROUND

Traditionally, vehicles have been provided with antennas mounted in different locations of the vehicle, being two of the most common locations the rear window (backlite) or roof location, for transmitting and receiving purposes. However, nowadays, these conventional antennas, specially the roof antennas that are typically designed as monopoles, do not achieve to provide an omni-directional coverage on all vehicles where are installed for all the frequencies and services considered in the vehicle environment. In the roof, depending on the frequency of operation (therefore the service) and the tilt of the roof, there are some directions that are not being covered, and therefore, the antenna is not acting with an omni-directional pattern. The tilt of the roof acts as an obstacle and makes that the antenna radiation is not omni-directional.

In these situations in which the shape of the roof acts as an obstacle, conventional antennas are unable to provide an adequate forward communication for the vehicle. As it can be seen in FIG. 1, the forward lobe of the antenna is mainly affected by the roof of the vehicle, since it acts as a reflector plane. Consequently, the forward lobe of the antenna radiation pattern is raised forming an $\alpha$-degree angle with respect to a horizontal plane, parallel to the ground, and an antenna misalignment is induced.

Aesthetic and aerodynamic changing trends constitute the reasons why the antenna proper performance has been affected. Automotive industry has to satisfy customer tastes which generally lead vehicles to have a streamlined and smooth appearance, at the same time that favors the fulfillment of aerodynamic performance, another requirement in the automotive industry.

On the other hand, while antennas for receiving RF signals, such as those generated by AM/FM terrestrial broadcast stations have been a main focus of automotive industry, new bands for communication are being increasingly demanded by customers, consumer electronics trends, and even standardization bodies. Both wireless and satellite communications have been implemented by numerous applications and devices, so, currently, meeting customer demands for wireless and satellite communication applications in the vehicle, is mandatory for the automotive industry.

There is, in fact, a trend in using higher operating frequencies for new communication services. In the case of traditional antennas mounted on the roof of the vehicle, the forward radiation of the antenna (as shown in FIG. 1), is being more affected due to the tilt of the roof.

Therefore, it would be desirable to develop an improved antenna for a vehicle that is capable of providing a robust communication for both forward and backward directions and therefore acting with an omni-directional behavior, at the same time that is capable of transmitting and/or receiving RF signals in each of the different frequency bands demanded by the wireless and satellite communication applications.

Additionally, it is still desired a high-performing antenna that, when installed on a vehicle, does not alter the aesthetic appearance of the vehicle nor creates a substantial visual obstruction for the driver.

BRIEF SUMMARY

This invention overcomes the above mentioned drawbacks by providing a new design for an antenna system for a vehicle. This new antenna system assures a robust forward and backward communication, and an omni-directional coverage when is installed on any type of vehicle. At the same time, this new antenna system keeps the smooth appearance of the vehicle, does not alter its aesthetic appearance and, additionally, it meets the requirements based on footprint antenna limitations when placed on the front area of the cockpit (by the window), not limiting the drivers visibility.

In one aspect of the invention, the antenna system for a vehicle comprises a first directive antenna device and a second antenna device, both antenna devices for operating at a frequency band of operation, and a reflector plane for both antenna devices. The first directive antenna device comprises:

- a first ground plane,
- a first dielectric substrate disposed on the first ground plane,
- a first antenna group disposed on the first dielectric substrate and shorted to the first ground plane, wherein the first antenna group comprises a first radiating conductor and a second radiating conductor arranged together forming a first configuration, wherein both radiating conductors are connected to the reflector plane by a first transmission lines electromagnetically coupled to the frequency band of operation for feeding the first antenna group, wherein the reflector plane is disposed forming an angle ranging from 60 to 90 degrees with respect to the first dielectric substrate, said first directive antenna device radiating in a direction of radiation, and wherein the second antenna device is connected to the first directive antenna device and configured for radiating in an opposing direction to the direction of radiation of the first directive antenna device.

In any event, for purposes of describing this invention, directive antenna should be understood as referring to an antenna whose directivity is higher than the isotopic antenna.

Therefore, a technical effect and advantage of the invention is an improvement in both the forward and the backward communication for the vehicle. The antenna system improves communication in both directions, as comprising a first directive antenna device, specially designed for providing a forward communication of the vehicle, and a second antenna device for a backward communication of the vehicle. This special design consists of that the first directive antenna device is configured for radiating in a direction of radiation, and the second antenna for radiating in the opposing direction.

It should be noted that the first antenna device is always referred as a directive solution while the second antenna device is not required to satisfy this condition in all the embodiments. Thus, according to one preferential embodiment, the second antenna device consist of a conventional antenna, for instance, as the current monopole antenna installed on the vehicle's roof operating at the required bands of the design. In this embodiment, the directive antenna will obtain a wireless connectivity for directions where the conventional antenna design does not obtain properly radiation pattern. In said embodiment, optimum performance will be obtained when the directive antenna is placed to cover all the wireless communication of the front direction (forward coverage) and the monopole antenna all the wireless communication of the back direction (backward coverage).

Additionally, the new antenna system is specially designed for providing an omni-directional coverage in any type of vehicle. Likewise, another technical effect and advantage of the invention is the achievement of a high-performing antenna system that, when installed in the vehicle, the overall antenna system radiation is not affected, so it provides omni-directional coverage. The integration between the first directive antenna device and the second antenna device allows the antenna system to guarantee a complete and comprehensive communication.

Additionally, the antenna system provides a radiation that it is not affected, even when both antenna devices operate at a high frequency band of operation. Thus, the antenna system assures an omni-directional coverage in any type of vehicle, also, for higher operating frequencies.

In this way, the antenna system also provides a more robust communication, since its radiation is not affected neither by its potential installation in the vehicle nor by the use of high frequencies. Likewise, possible antenna misalignments are reduced since the antenna system radiation pattern, formed by the integration of the two antenna devices, is wide enough to reach the system with which it is in communication and to maintain the communication.

Thereby, the antenna system is able to tolerate certain displacements in its emplacement, without the communication being affected. This is another advantage of the invention. The antenna system provides a strong communication, which also reverts in an antenna system with a more versatile installation, since said antenna allows a more flexibility in its vehicle installation, without signal dropping during the communication.

This versatility and flexibility allows providing an antenna system that does not create a substantial visual obstruction, endangering driver safety. Otherwise, the invention strengthens the driver safety, as being the antenna system able to be installed in several possible locations. At the same time, this versatility and flexibility strengthen meeting both aesthetic and aerodynamic requirements that the automotive industry must comply.

The new antenna system provides excellent performance characteristics when transmitting and/or receiving signals operating in the radio frequency range, preferably, in the WiFi and Satellite Communication bands, regardless of the operation bands of those two systems. These characteristics include high radiation gain, high radiation efficiency, and wider bandwidths at the select frequency band of operation. Because the antenna system is suitable for being integrated in the front window area, the antenna system is relatively compact, occupying a relatively small area when is installed on the windshield, yet providing a high performance when transmitting or receiving. Furthermore, the compact size of the antenna system strengthens the driver's visibility and minimizes aesthetic challenges. Therefore, the new antenna system is desirable for automotive manufacturers.

BRIEF DESCRIPTION OF THE DRAWINGS

For a better comprehension of the invention, the following drawings are provided for illustrative and non-limiting purposes, wherein.

DETAILED DESCRIPTION

Figure 1:
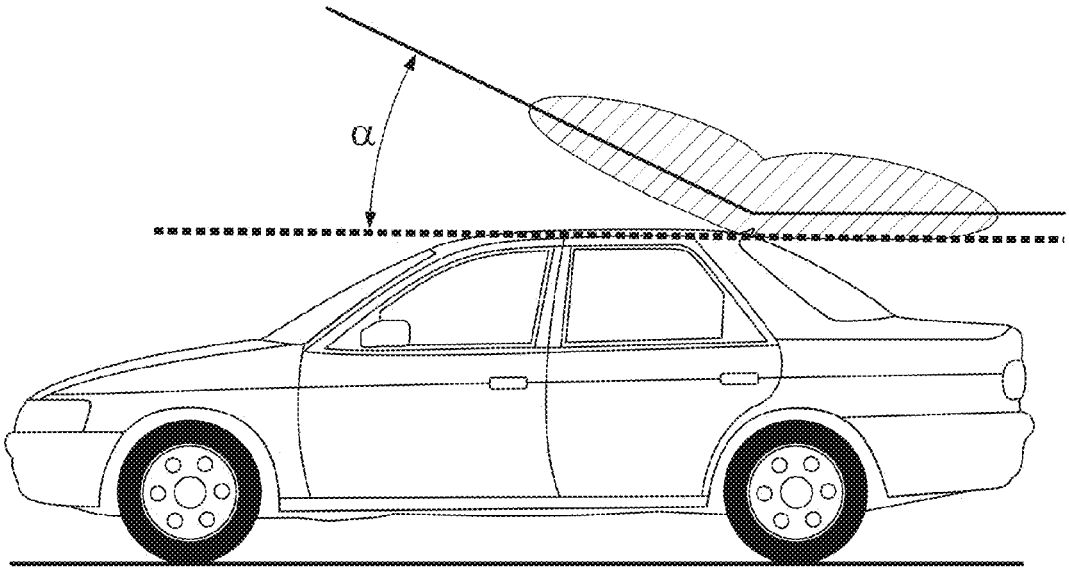
FIG. 1 (Prior art)
FIG. 1 shows a prior art view of a vehicle wherein the shape of the roof acts as an obstacle for the radiation of its conventional antenna, and wherein the forward lobe of the antenna radiation pattern is raised an $\alpha$-degree angle in consequence.
Figure 2:
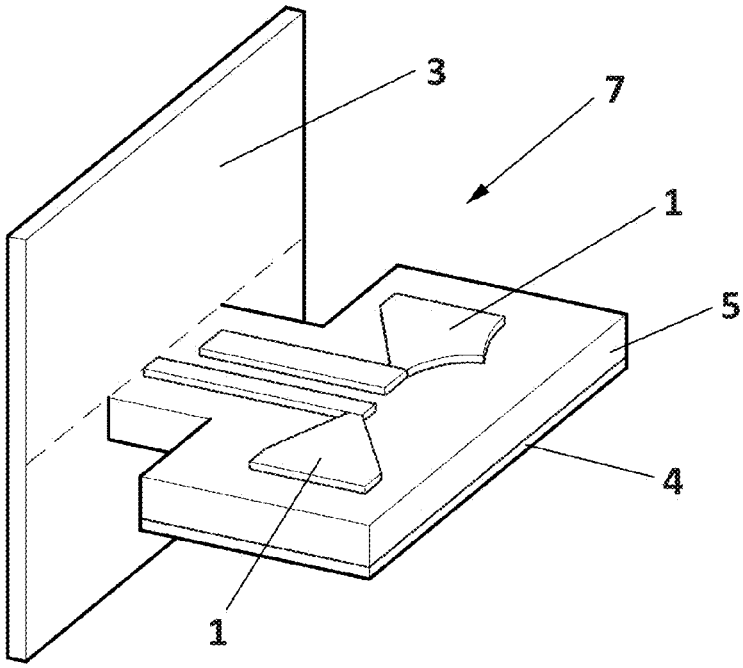
FIG. 2 shows a perspective view of the first directive antenna device, according to a preferential embodiment of the invention.
Figure 3A:
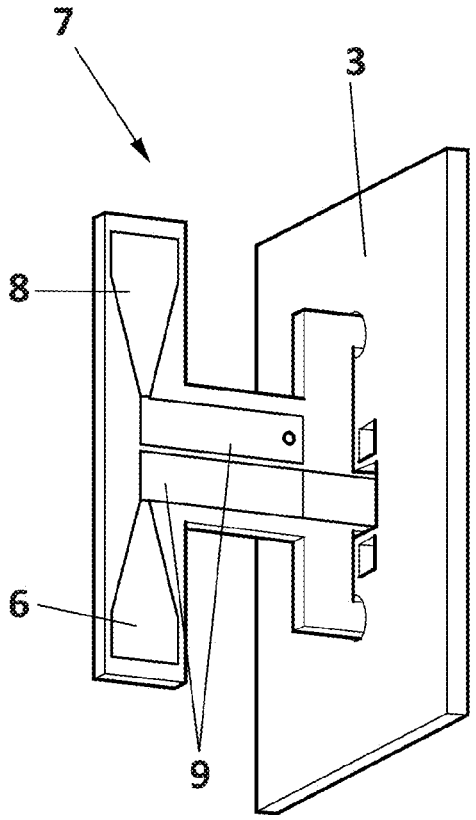
FIGS. 3*a* and 3*b* show perspective views, respectively, of the front side and the back side of the first directive antenna device, according to the preferred embodiment of FIG. 2.
Figure 3B:
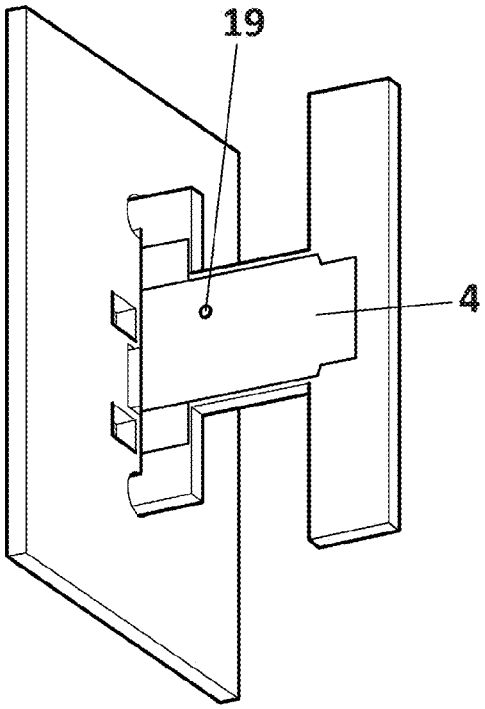

Referring to FIGS. 2 and 3, a preferred embodiment of the first directive antenna device 7 is shown. According to said embodiment, the first directive antenna device 7 comprises: a first ground plane 4, a first dielectric substrate 5 disposed on the first ground plane 4, and a first antenna group 1 disposed on the first dielectric substrate 5 and shorted to the first ground plane 4.

Preferentially, the first antenna group 1 comprises: a first radiating conductor 6 and a second radiating conductor 8 arranged together forming a first bowtie-shaped configuration, wherein both radiating conductors 6, 8 are connected to the reflector plane 3 by a first transmission lines 9 electromagnetically coupled to the frequency band of operation for feeding the first antenna group 1.

Additionally, the reflector plane 3 for the first directive antenna device 7 is disposed forming an angle ranging from 60 to 90 degrees with respect to the first dielectric substrate 5. According to the preferred embodiment shown in FIGS. 2 and 3, the reflector plane 3 is disposed substantially orthogonal with respect to the first dielectric substrate 5.

FIGS. 2 and 3*a* show the first and the second radiating conductors 6, 8 arranged together forming a first bowtie-shaped configuration. However, in other preferential embodiment of the invention, the first configuration may correspond to one of the configurations of the group that comprises: an elliptic-shaped configuration, a diamond-shaped configuration, a rectangular-shaped configuration and a rectified horn-shaped configuration.

Figure 4:
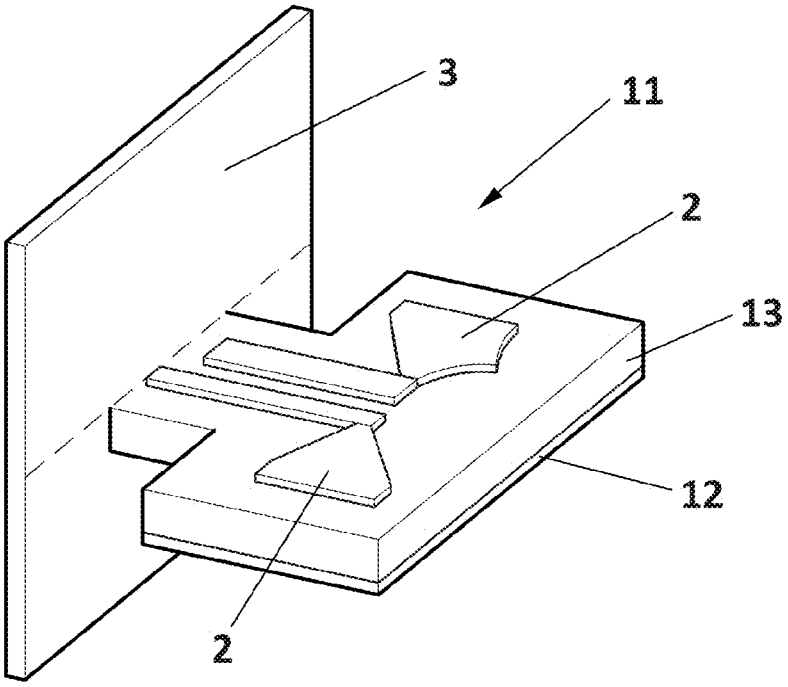
FIG. 4 shows a perspective view of the second directive antenna device, according to another preferential embodiment of the invention.
Figure 5A:
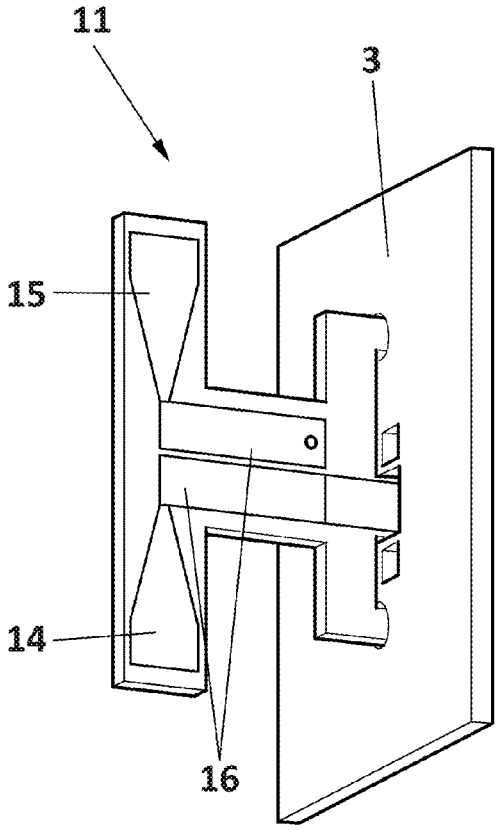
FIGS. 5*a* and 5*b* show perspective views, respectively, of the front side and the back side of the second directive antenna device, according to the preferred embodiment of FIG. 4.
Figure 5B:
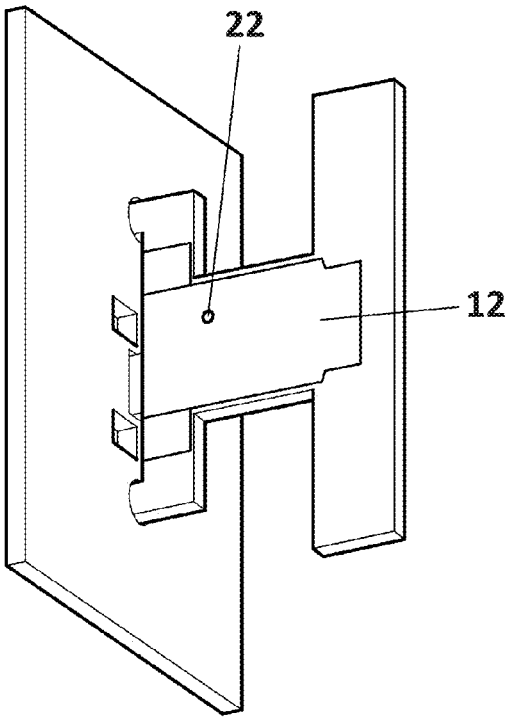
Figure 6:
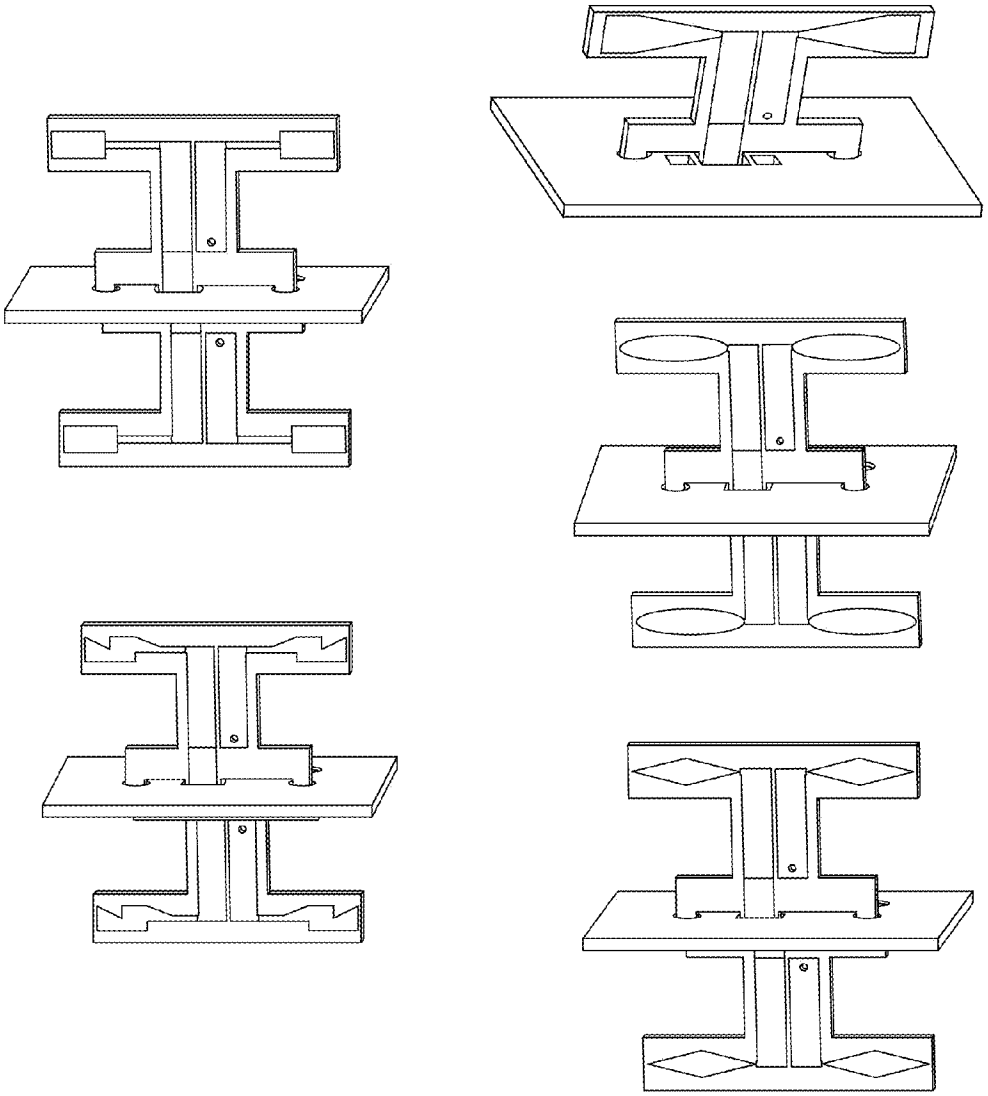
FIG. 6 shows perspective views of possible configurations for the first, second, third and fourth radiating conductors of the antenna system, according to another preferential embodiment of the invention.

Likewise, referring to FIGS. 4 and 5, a preferred embodiment of the second directive antenna device 11 is shown. According to said embodiment, the second directive antenna device 11 comprises: a second ground plane 12, a second dielectric substrate 13 disposed on the second ground plane 12, and a second antenna group 2 disposed on the second dielectric substrate 13 and shorted to the second ground plane 12. Said configurations are shown in FIG. 6.

Preferentially, the second antenna group 2 comprises: a third radiating conductor 14 and a fourth radiating conductor 15 arranged together forming a second bowtie-shaped configuration, wherein both third and fourth radiating conductors 14, 15 are connected to the opposite side of the reflector plane 3 wherein the first antenna group 1 is connected, wherein both third and fourth radiating conductors 14, 15 are connected by means of a second transmission lines 16 electromagnetically coupled to the frequency band of operation for feeding the second antenna group 2.

Additionally, the reflector plane 3 is disposed forming an angle ranging from 60 to 90 degrees with respect to the second dielectric substrate 13. According to the preferred embodiment shown in FIGS. 4 and 5, the reflector plane 3 is disposed substantially orthogonal with respect to the second dielectric substrate 13.

FIGS. 4 and 5*a* show the third and the fourth radiating conductors 14, 15 arranged together forming a second bowtie-shaped configuration. However, in other preferential embodiments of the invention, the second configuration may correspond to one of the configurations of the group that comprises: an elliptic-shaped configuration, a diamond-shaped configuration, a rectangular-shaped configuration, a rectified horn-shaped configuration and a configuration wherein the radiation conductor is formed by segments spaced at their extremes wherein corresponding opposing angles are formed. Said configurations are shown in FIG. 6 and in FIG. 10, wherein the opposing angles have been identified as $\gamma$ and $\beta$ and the separation between the segments that formed the radiation conductor as W1 and W2.

According to another preferential embodiment of the invention, the antenna system 45 for a vehicle comprises a first directive antenna device 7 and a second antenna device, both antenna devices for operating on a frequency band of operation, and a reflector plane 3 for both antenna devices. The first directive antenna device 7 being as above referred for FIGS. 2 and 3, and the second antenna device being the second directive antenna device 11 as above referred for FIGS. 4 and 5.

Figure 7:
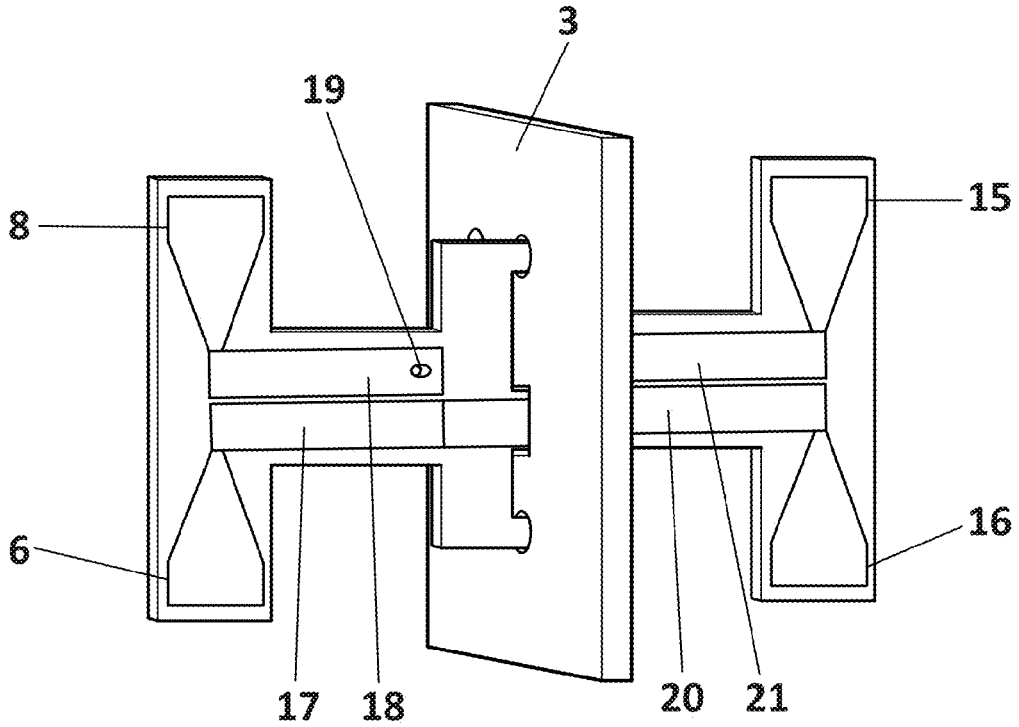
FIG. 7 shows a perspective view of the antenna system, according to the preferred embodiments of FIGS. 2 and 4, wherein the first and the second transmission lines are shown. Each transmission line is formed by two microstrip transmission lines electromagnetically coupled to the frequency band of operation.

FIG. 7 shows another preferential embodiment. In said embodiment, the first transmission lines 9 are formed by two microstrip transmission lines, a first line 17 that extends from a microstrip transmission feeding line coming into the reflector plane 3 for feeding the first directive antenna device 7, and a second line 18, parallely disposed to the first line 17, providing the shorted 19 to the first ground plane 4 at the one of its ends closest to the reflector plane 3, the first line 17 connected to the first radiating conductor 6 and the second line 18 connected to the second radiating conductor 8, both lines 17, 18 with a length of a one-fourth of an effective wavelength $\lambda_1$ corresponding to the center frequency of the frequency band of operation.

Additionally, in another preferred embodiment, the second transmission lines 16 are formed by two microstrip transmission lines, a third line 20 that extends from the microstrip transmission feeding line coming into the reflector plane 3 for feeding the second directive antenna device 11, and a fourth line 21, parallely disposed to the third line 20, providing a second shorted 22 to the second ground plane 12 at the one of its ends closest to the reflector plane 3, the third line 20 connected to the third radiating conductor 14 and the fourth line 21 connected to the fourth radiating conductor 15, both lines 20, 21 with a length of a one-fourth of an effective wavelength $\lambda_1$ corresponding to the center frequency of the frequency band of operation.

Figure 8:
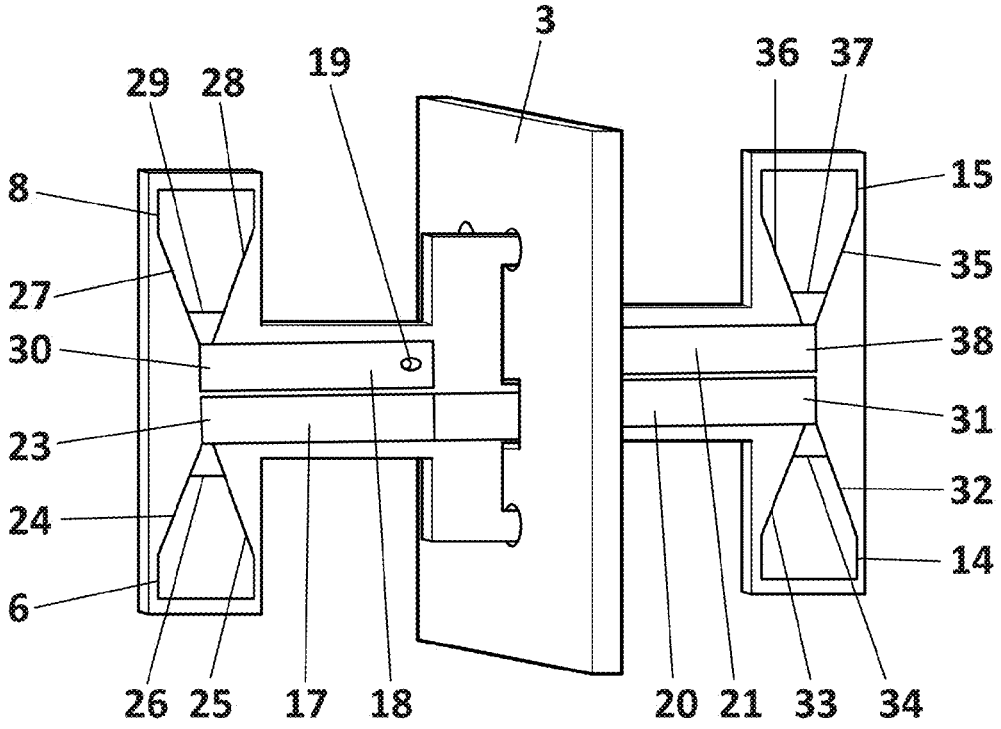
FIG. 8 shows a perspective view of the antenna system, according to the preferred embodiment of FIG. 7, wherein the elements that formed each one of the radiating conductors are shown.

FIG. 8 shows another preferential embodiment. In said embodiment, the first and the second radiating conductors 6, 8 are arranged together forming the first configuration as a first bowtie-shaped configuration. The first radiating conductor 6 extends orthogonally to the first line 17 at its distal end 23 referring to the reflector plane 3, wherein the first radiating conductor 6 comprises a first segment 24 and a second segment 25 divergently extending from said distal end 23, both segments 24, 25 forming a first angle 26 that is within the range 20 to 30 degrees.

Additionally, in another preferred embodiment, the second radiating conductor 8 extends orthogonally to the second line 18 at its distal end 30 referring to the reflector plane 3, wherein the second radiating conductor 8 comprises a first segment 27 and a second segment 28 divergently extending from said distal end 30, both segments 27, 28 forming a second angle 29 that is within the range 20 to 30 degrees.

In another preferential embodiment, the third and the fourth radiating conductors 14, 15 arranged together forming the second configuration as a second bowtie-shaped configuration. The third radiating conductor 14 extends orthogonally to the third line 20 at its distal end 31 referring to the reflector plane 3, wherein the third radiating conductor 14 comprises a first segment 32 and a second segment 33 divergently extending from said distal end 31, both segments 32, 33 forming a third angle 34 that is within the range 20 to 30 degrees.

Additionally, in another preferred embodiment, the fourth radiating conductor 15 extends orthogonally to the fourth line 21 at its distal end 38 referring to the reflector plane 3, wherein the fourth radiating conductor 15 comprises a first segment 35 and a second segment 36 divergently extending from said distal end 38, both segments 35, 36 forming a fourth angle 37 that is within the range 20 to 30 degrees.

Figure 9:
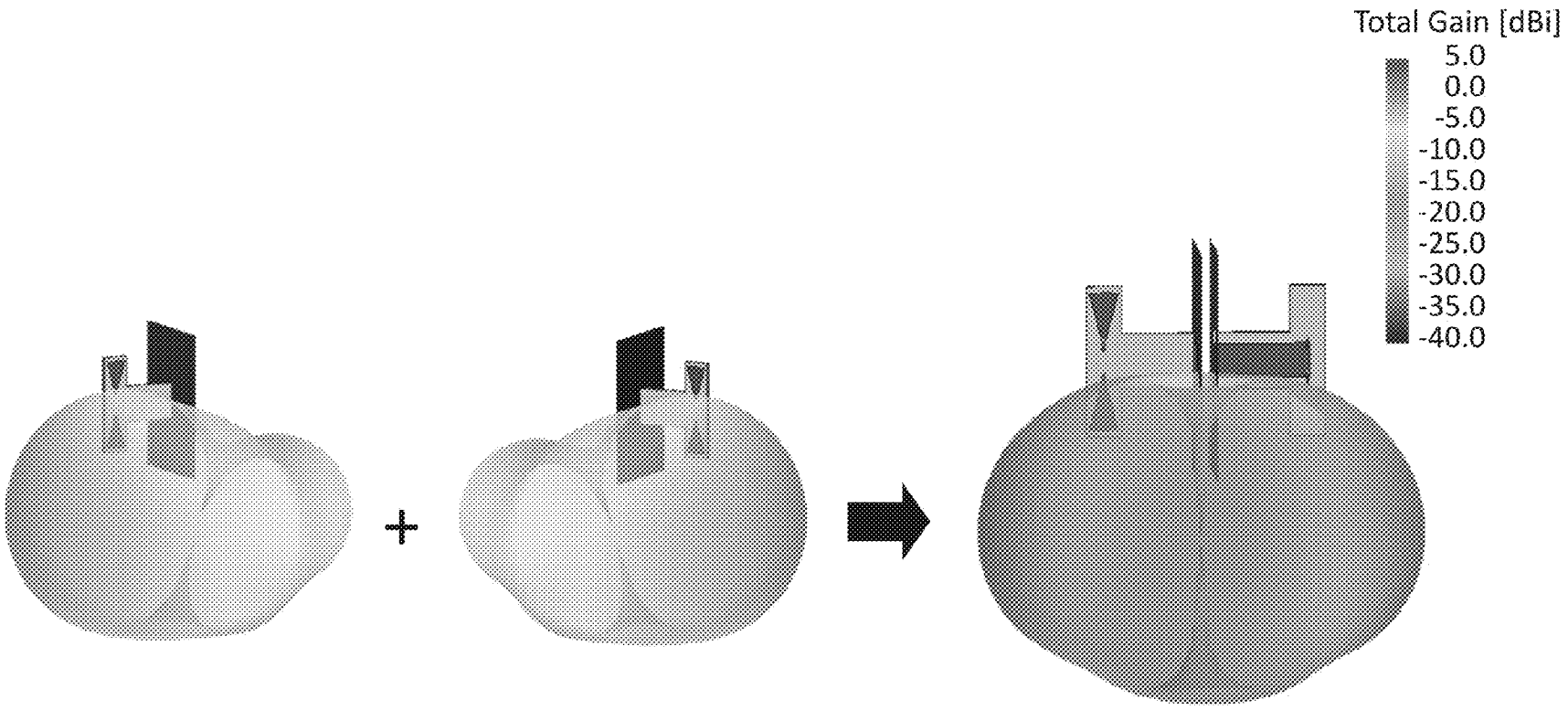
FIG. 9 shows the omni-directional coverage that the antenna system achieves, wherein said antenna system is formed by two directive antenna devices, according to another preferential embodiment for the invention.

FIG. 9 shows the pattern radiation of the first directive antenna device 7, of the second directive antenna device 11, and of their combination, forming the antenna system pattern radiation, according to another preferential embodiment. The first directive antenna device 7 is configured for radiating in a direction of radiation, and the second directive antenna device 11 is configured for radiating in an opposing direction to the direction of radiation of the first directive antenna device 7.

According to this embodiment, the first directive antenna device 7 radiates in a forward direction, and the second directive antenna device 11 in a backward direction. The radiated power of both antenna devices 7, 11 is not diverted into side lobes, thus, the invention provides high-performing directive antenna devices with excellence performance characteristics for emitting and/or receiving, having a wide beamwidth on the horizontal plane. In this way, the invention assures both forward and backward communication for the vehicle.

Moreover, given that the antenna system radiation pattern provides an omni-directional coverage, the invention ensures the communication at any direction, with a high radiation gain, high radiation efficiency, and with almost a 360-degree horizontal and vertical beamwidth, closing to provide a spherical radiation pattern, with the exception of a slight decay in the center of its elevation pattern.

Figure 10:
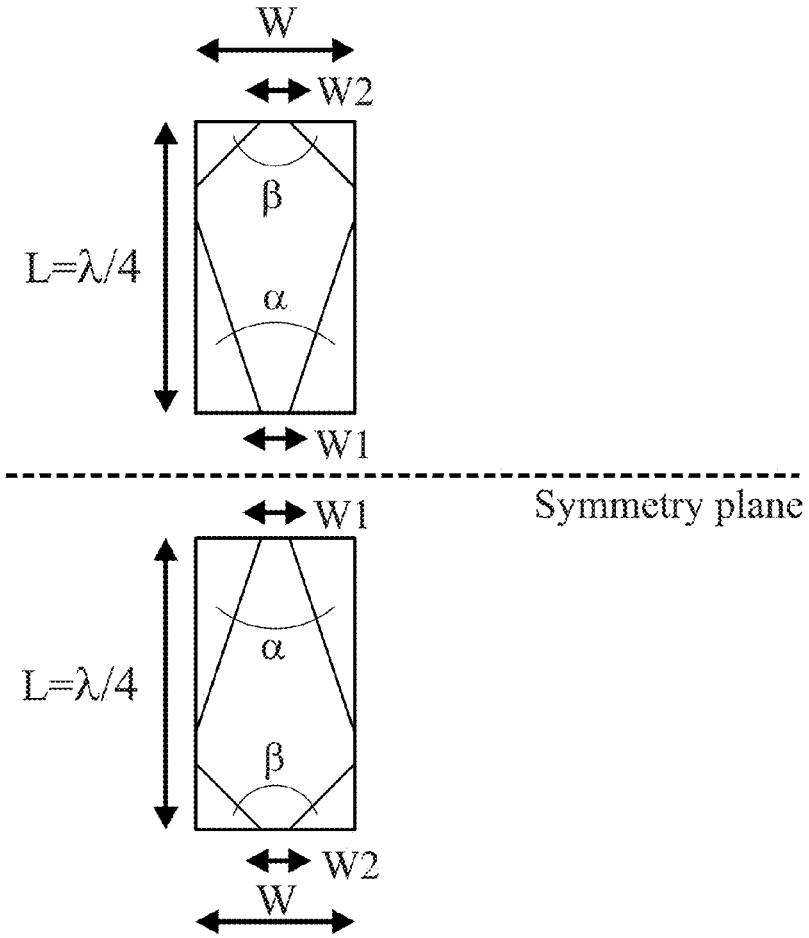
FIG. 10 shows the design parameters of the elements that formed each one of the radiating conductors, according to another preferential embodiment for the invention.

These radiation patterns obey to a specific design of the antenna system. FIG. 10 shows a preferential embodiment for the bowtie-shaped configuration, wherein the design parameters and the preferred dimensions are specified. According to this embodiment, each of the first and the second conductors 6, 8 has a length L and two widths W1, W, a first width W1 corresponding to the connection between the first line 17 and the first radiating conductor 6 and the second width W corresponding to the distance between the first and the second segment of each of the first and the second radiating conductors 6, 8, the length L being a one-fourth of an effective wavelength $\lambda_1$ corresponding to the center frequency of the frequency band of operation, the second width W being a one-eighth of an effective wavelength $\lambda_1$ corresponding to the center frequency of the frequency band of operation, and the first width W1 equal to 0.5 mm.

Additionally, in another preferred embodiment, the third and the fourth radiating conductors 14, 15 has a length L' and two widths W1', W', a first width W1 corresponding to the connection between the third line 20 and the third radiating conductor 14 and the second width W' corresponding to the distance between the first and the second segment of each of the third and the fourth radiating conductors 14, 15, the length L' corresponding of a one-fourth of an effective wavelength $\lambda_1$ corresponding to the center frequency of the frequency band of operation, the second width W' corresponding of a one-eighth of an effective wavelength $\lambda_1$ corresponding to the center frequency of the frequency band of operation, and the first width W1' equal to 0.5 mm.

In a preferred embodiment, the first and the second 6, 8 radiating conductors has the preferred length L and widths W1, W, as above mentioned, the third and the fourth radiating conductors 14, 15 has the preferred length L' and widths W1', W', as above mentioned, and the first angle 26, the second angle 29, the third angle 34 and the fourth angle 37 are equal to 30 degrees. With this preferred embodiment, the antenna system 45 achieves percentage bandwidth values in excess of 25%.

Preferably, the frequency band of operation of the antenna system 45 is within one of the following ranges or frequencies of operation: 1.5-1.6 GHz; 2.4-2.5 GHz; 3.5-3.6 GHz; 3.6-3.7 GHz; 4.9-5.8 GHz; 5.8-6.0 GHz. So, the antenna system 45 may preferably use satellite communication channels, 1.5-1.6 GHz, or WiFi channels, corresponding to 2.4-2.5 GHz, 3.5-3.6 GHz, 3.6-3.7 GHz, 4.9-5.8 GHz, or WiMAX channel, 3.5 GHz, or Dedicated Short-Range Communications (DSRC) or Vehicle-to-Vehicle and Vehicle-to-Infrastructure (V2X or C2X) corresponding to 5.8-6.0 GHz. Thus, the antenna system 45 allows the use of wireless and satellite communication applications, satisfying the increasingly customer demand for communication in these bands.

Therefore, the antenna system 45 provides DSRC and/or V2X or C2X, since allows a one-way or two-way, short to medium-range communication, using wireless communication channels, specifically designed for the automotive use. Thus, the antenna system 45, comply with the communication requirements in the automotive industry.

In another preferred embodiment, the invention provides a vehicle, with a front window and with the antenna system 45, according to the present invention, wherein the reflector plane, of said antenna system 45, is disposed substantially parallel to the ground. Preferably, the antenna system 45 is disposed in one of the vehicle locations of the group that comprises: the front window area, preferentially close to the windshield, a backlite area, a front or rear bumper, a spoiler, a fender, a decklid, a dashboard, an interior mirror, an exterior mirror, and a rear-brake light.

Figure 11:
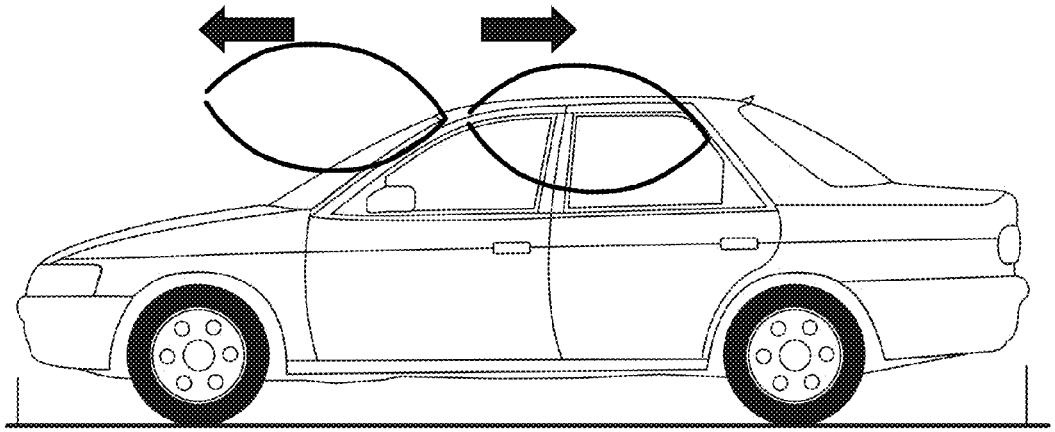
FIG. 11 shows a side view of a vehicle wherein the antenna system is disposed in its front area window, according to another preferential embodiment of the invention. Additionally, the figure schematically shows the forward and backward lobe corresponding to the radiation of the antenna devices.

FIG. 11 shows a vehicle with the antenna system 45 installed in is front window. Schematically, the figure shows the forward and backward lobe corresponding to the radiation of the two directive antenna devices that formed the antenna system 45, according to one embodiment of the invention. As it is shown, neither lobe is affected by the roof of the vehicle, since the position of the antenna in the front window area provides full visibility of all the different angles of the car. The antenna system 45 is suitable for whatever type of vehicle as it does not depend on the shape of the roof wherein is installed. Additionally, the antenna system 45 is suitable for using high frequencies, such as those for wireless, WiFi, V2X, WiMAX or satellite communications, as its directivity is not affected thereby.

Figure 12:
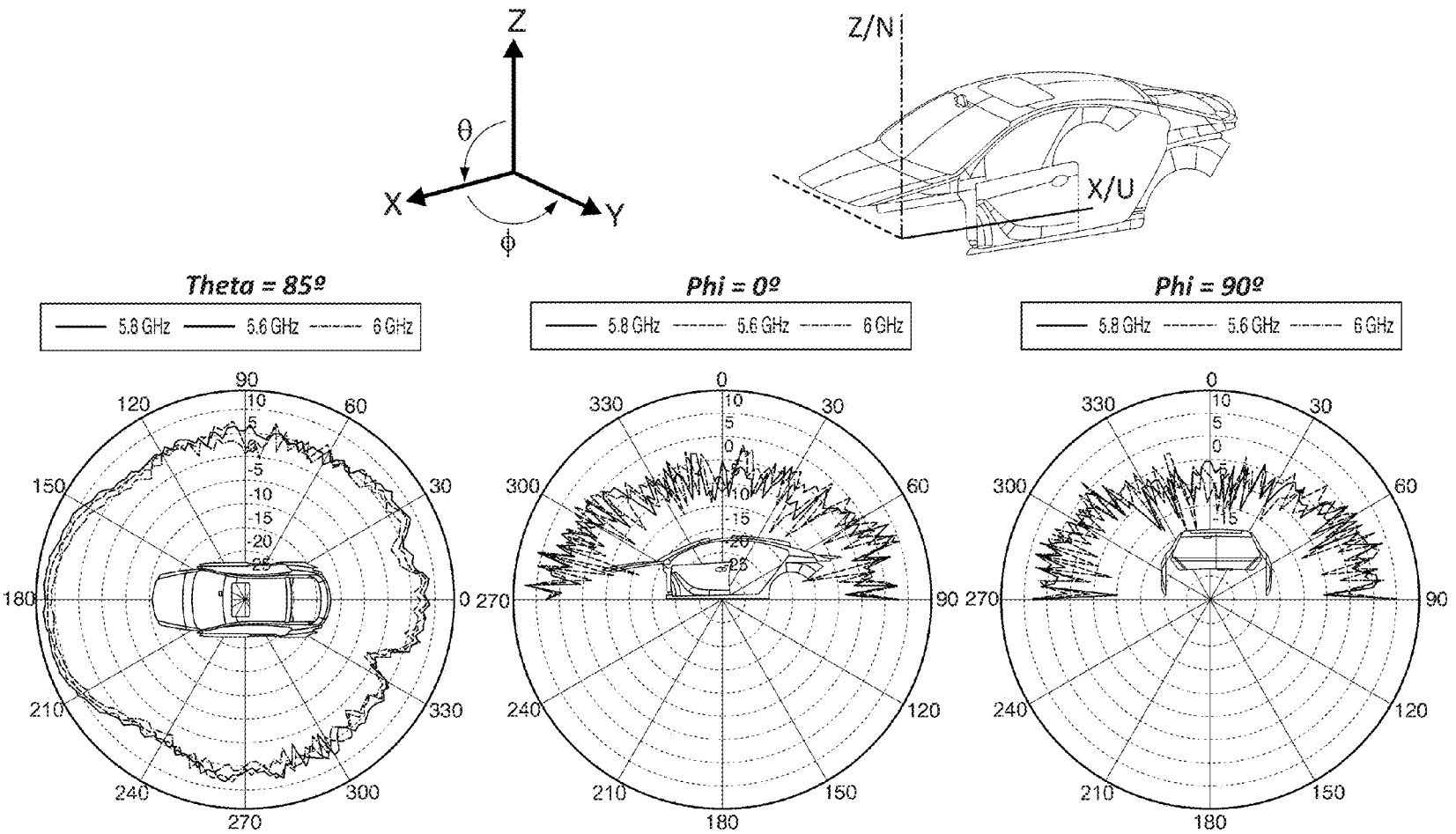
FIG. 12 shows schematic views of the antenna system radiation pattern once the antenna system is installed on the vehicle, according to another preferential embodiment of the invention.

In turn, FIG. 12 shows schematic views of the antenna system radiation pattern when the antenna system 45 is installed on the central upper side of the front window of the vehicle. In the left view ($\theta=90°$), is shown the azimuth pattern wherein the antenna system 45 provides a coverage over the 360° of the horizontal plane. In the central and right views ($\phi=0°$; $\phi=90°$) the radiation exhibits a higher gain in the extremes, assimilating a forward and a backward lobe in the antenna system radiation pattern.

According to another preferential embodiment of the invention, the antenna system 45 comprises the first directive antenna device 7, as referred above for FIGS. 2 to 12, and a second antenna device, wherein said second antenna device is connected to the first directive antenna device 7 and configured for radiating in an opposing direction to the direction of radiation of the first directive antenna device 7. According to this embodiment, the second antenna device can be a conventional antenna, such as a whip antenna, wherein said second antenna device is connected to the first directive antenna device 7 and configured for radiating in an opposing direction.

Figure 13:
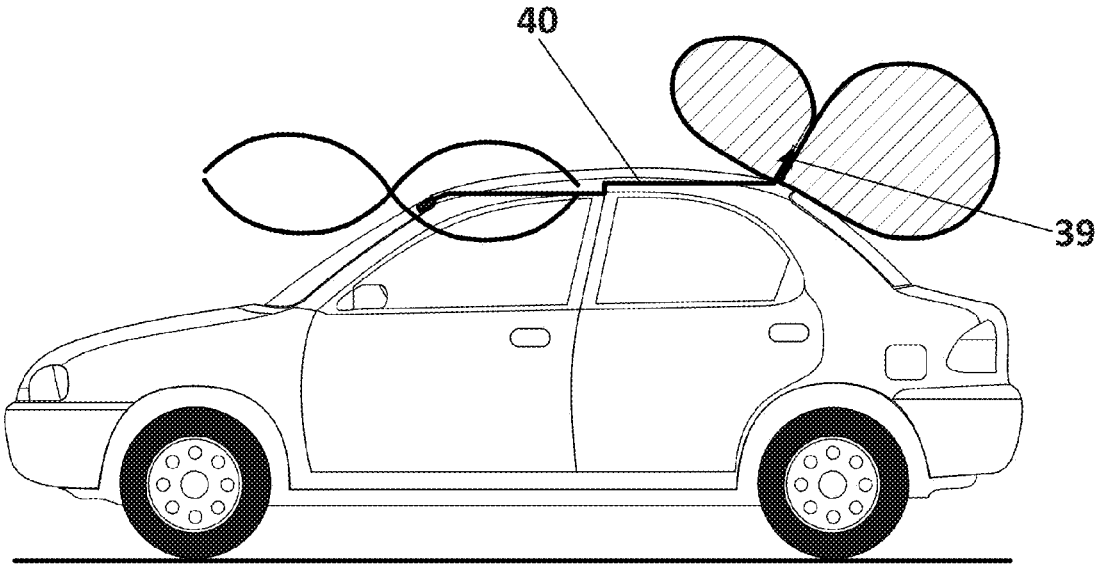
FIG. 13 shows a side view of a vehicle wherein the first directive antenna device, disposed in its front window, it is connected to a conventional antenna device, forming the antenna system, according to another preferential embodiment of the invention.

As shown in FIG. 13, in another preferential embodiment, the second antenna device is a monopole antenna device 39 disposed on the roof of the rear end of the vehicle, and is connected to the first antenna device by cable means 40, for instance, coaxial type, Ethernet, or any other type.

Thus, the antenna system is also suitable for being installed also in vehicles that are already provided with an antenna. So, the antenna system provides a strengthen communication for the vehicle.

At the same time, the antenna system eases its installation on the vehicle, as comprising as second antenna device, either a second directive antenna device (similar to the first directive antenna device) or a second antenna device, such as a monopole antenna device or a conventional whip antenna.

Additionally, in another preferential embodiment, a vehicle comprises a receiver configured for processing radio signals and the antenna system above-mentioned, wherein the receiver is configured for processing the signals received by the antenna system 45 and wherein said antenna system 45 is contained within a package 47 that additionally includes the receiver.

Alternatively, in another preferential embodiment, a vehicle comprises a receiver having a front-end part and being configured for processing the signals received by the antenna system 45, wherein the antenna system 45 is contained within a package 47 that, at least, additionally includes the front-end of the receiver.

In a preferred embodiment, a vehicle comprises a receiver configured for processing radio signals and the antenna system 45 is allocated over a printed circuit board 48 where the receiver is placed.

Figure 14:
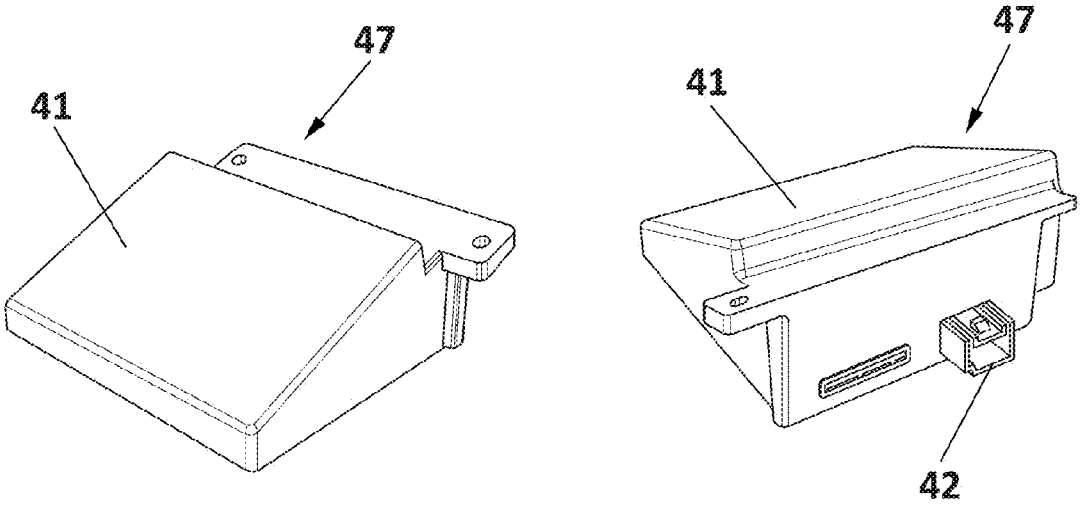
FIG. 14 shows different perspective views of the package that contained the antenna system and the receiver, according to another preferential embodiment of the invention.

FIG. 14 shows different perspective views of the package 47 wherein the antenna system 45 and the receiver, or at least, the front-end of the receiver are contained.

Figure 15:
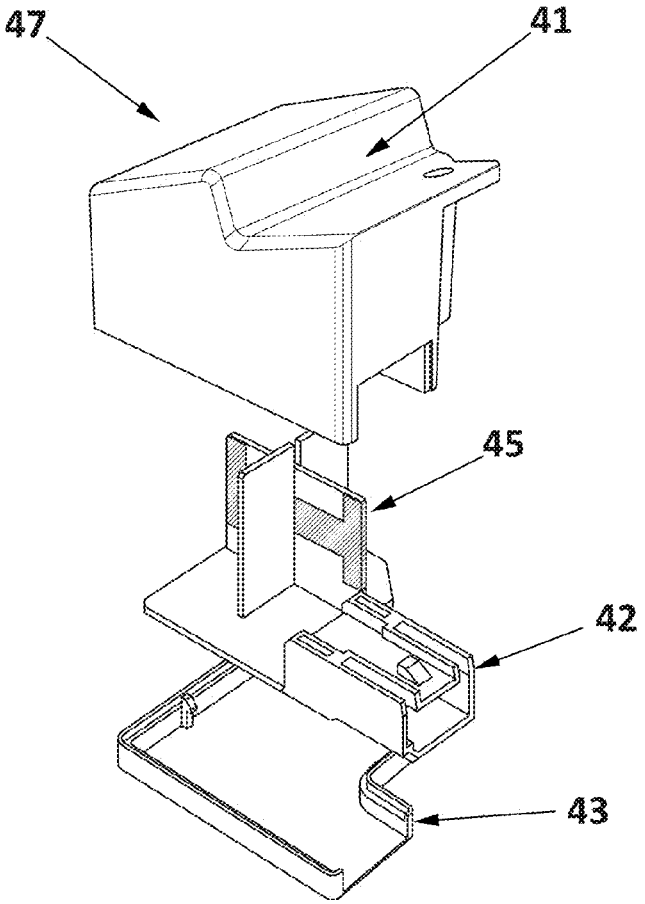
FIG. 15 shows an exploded view of the package showed in FIG. 14.

FIG. 15 shows an exploded view of the package 47, which comprises a cover 41 and a base 43 that enclose the receiver and the antenna system 45. Additionally, the package 47 can be provided with an USB connection 42.

Figure 16:
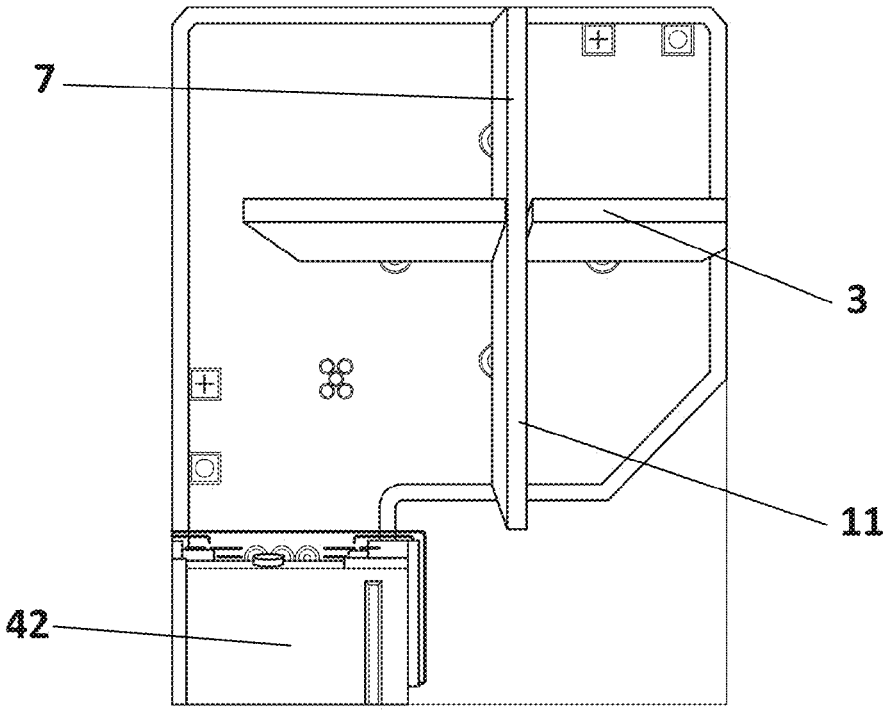
FIG. 16 shows a great detail of the antenna system contained in the package, according to another preferential embodiment of the invention.

FIG. 16 shows a great detail of the antenna system 45 contained in the package 47 wherein the first directive antenna device 7, the second directive antenna device 11 and the reflector plane 3 are identified.

Figure 17:
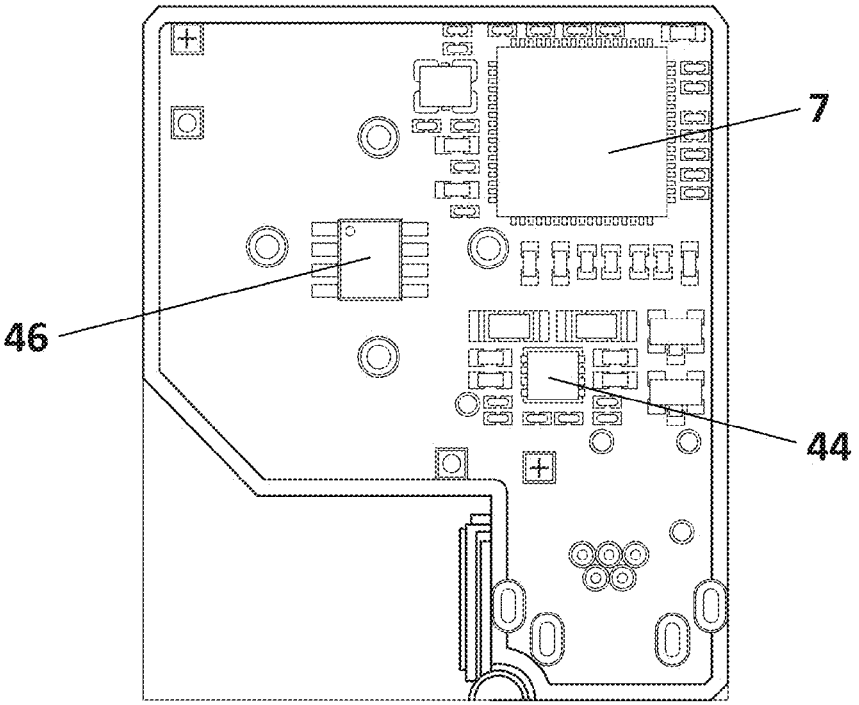
FIG. 17 shows a great detail of the first directive antenna device circuitry, according to another preferential embodiment of the invention.

FIG. 17 shows a great detail of the first directive antenna device circuitry, wherein the first directive antenna device 7, a power 44 that feed it, and a flash memory 47 are identified.

Figure 18:
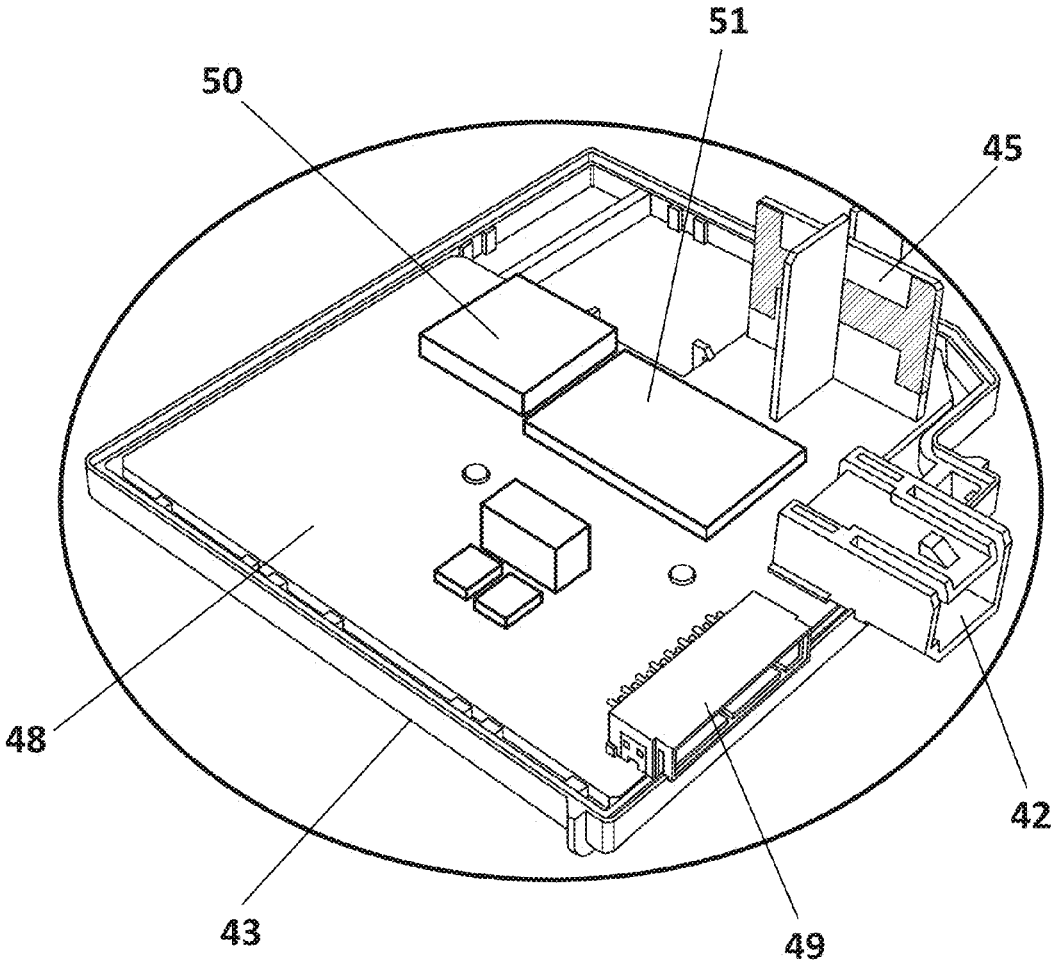
FIG. 18 shows a component integration contained by the package including the antenna system, according to another preferential embodiment of the invention.

FIG. 18 shows a component integration inwardly contained by the package 47 according to another preferential embodiment. Supported by the base 43 of the package 47, said integration comprises the printed circuit board 48, wherein the antenna system 45 is allocated, a Global Navigation Satellite System (GNSS) antenna 50, a main connector 49 to be used to provide power to the component integration, and also for providing connectivity to the Controller Area Network (CAN) Bus, or to any other Bus of the vehicle, and a power management processor 51. Particularly, as being a GNSS antenna 50 type, said antenna may operate with GPS, Galileo, GLONASS, Beidou-Compass, or any other satellite reception system. Additionally, the package 47 can be provided with other connections for data transfer purposes, such as an Ethernet connection. At the other side of the printed circuit board 48, not shown in the figure, other components may be allocated, for instance a processor, a GNSS receiver, memories, CAN controllers, CAN drivers, an Ethernet controller, etc.

Further, the layout and the compact size of the antenna system make it non-obtrusive to the driver's visibility and therefore, minimize aesthetic and safety obstructions. Likewise, the invention aids in reducing antenna damage or theft, as being possible to embed the antenna system, in the front window, backlite, bumper or in any part of the vehicle in which is desired to install.

The invention claimed is:

1. Antenna system for a vehicle comprising a first directive antenna device and a second antenna device, both antenna devices configured to operate at a frequency band of operation, and a single reflector plane for both antenna devices, wherein, the first directive antenna device comprises:

a first ground plane, a first dielectric substrate overlapping the first ground plane, a first antenna group stacked on the first dielectric substrate and shorted to the first ground plane, wherein the first antenna group comprises a first radiating conductor and a second radiating conductor stacked on the first dielectric substrate and arranged together forming a first configuration, wherein both radiating conductors are connected to the same single reflector plane by a first transmission lines electromagnetically coupled to the frequency band of operation for feeding the first antenna group, wherein the single reflector plane is disposed forming an angle ranging from 60 to 90 degrees with respect to the first dielectric substrate, said first directive antenna device is configured for radiating in a direction of radiation, and wherein the second antenna device is connected to the first directive antenna device and configured for radiating in an opposing direction to the direction of radiation of the first directive antenna device.

2. The antenna system, according to claim 1, wherein the second antenna device is a second directive antenna device comprising:

a second ground plane, a second dielectric substrate overlapping the second ground plane, a second antenna group stacked on the second dielectric substrate and shorted to the second ground plane, wherein the second antenna group comprises a third radiating conductor and a fourth radiating conductor stacked on the second dielectric substrate and arranged together forming a second configuration, wherein both third and fourth radiating conductors are connected to the backside of the reflector plane wherein the first antenna group is connected, wherein both third and fourth radiating conductors are connected by means of a second transmission lines electromagnetically coupled to the frequency band of operation for feeding the second antenna group, and wherein the reflector plane is disposed forming an angle ranging from 60 to 90 degrees with respect to the second dielectric substrate.

3. The antenna system, according to claim 1, wherein each of the first and the second configuration corresponds to one of the configuration of the group that comprises: a bowtie-shaped configuration, an elliptic-shaped configuration, a diamond-shaped configuration, a rectangular-shaped configuration, a rectified horn-shaped configuration and a configuration wherein the radiation conductor is formed by segments spaced at their extremes wherein corresponding opposing angles are formed.

4. The antenna system, according to claim 1, wherein, the first transmission lines are formed by two microstrip transmission lines, a first line that extends from a microstrip transmission feeding line coming into the reflector plane for feeding the first directive antenna device, and a second line, disposed in parallel to the first line, providing the shorted to the first ground plane at the one of its ends closest to the reflector plane, the first line connected to the first radiating conductor and the second line connected to the second radiating conductor, both lines with a length of a one-fourth of an effective wavelength $\lambda_1$ corresponding to the center frequency of the frequency band of operation.

5. The antenna system, according to claim 2, wherein, the second transmission lines are formed by two microstrip transmission lines, a third line that extends from the microstrip transmission feeding line coming into the reflector plane for feeding the second directive antenna device, and a fourth line, disposed in parallel to the third line, providing a second shorted to the second ground plane at the one of its ends closest to the reflector plane, the third line connected to the third radiating conductor and the fourth line connected to the fourth radiating conductor, both lines with a length of a one-fourth of an effective wavelength $\lambda_1$ corresponding to the center frequency of the frequency band of operation.

6. The antenna system, according to claim 3, wherein, the first and the second radiating conductors arranged together forming the first configuration as a first bowtie-shaped configuration, the first radiating conductor extends orthogonally to the first line at its distal end referring to the reflector plane, wherein the first radiating conductor comprises a first segment and a second segment divergently extending from said distal end, both segments forming a first angle that is within the range 20 to 30 degrees.

7. The antenna system, according to claim 3, wherein, the second radiating conductor extends orthogonally to the second line at its distal end referring to the reflector plane, wherein the second radiating conductor comprises a first segment and a second segment divergently extending from said distal end, both segments forming a second angle that is within the range 20 to 30 degrees.

8. The antenna system, according to claim 5, wherein, the third and the fourth radiating conductors arranged together forming the second configuration as a second bowtie-shaped configuration, the third radiating conductor extends orthogonally to the third line at its distal end referring to the reflector plane, wherein the third radiating conductor comprises a first segment and a second segment divergently extending from said distal end, both segments forming a third angle that is within the range 20 to 30 degrees.

9. The antenna system, according to claim 5, wherein, the fourth radiating conductor extends orthogonally to the fourth line at its distal end referring to the reflector plane, wherein the fourth radiating conductor comprises a first segment and a second segment divergently extending from said distal end, both segments forming a fourth angle that is within the range 20 to 30 degrees.

10. The antenna system, according to claim 4, wherein each of the first and the second conductors has a length and two widths, a first width corresponding to the connection between the first line and the first radiating conductor and the second width corresponding to the distance between the first and the second segment of each of the first and the second radiating conductors, the length being a one-fourth of an effective wavelength $\lambda_1$ corresponding to the center frequency of the frequency band of operation, the second width being a one-eighth of an effective wavelength $\lambda_1$ corresponding to the center frequency of the frequency band of operation, and the first width equal to 0.5 mm.

11. The antenna system, according to claim 5, wherein each of the third and the fourth radiating conductors has a length and two widths, a first width corresponding to the connection between the third line and the third radiating conductor and the second width corresponding to the distance between the first and the second segment of each of the third and the fourth radiating conductors, the length corresponding of a one-fourth of an effective wavelength $\lambda_1$ corresponding to the center frequency of the frequency band of operation, the second width corresponding of a one-eighth of an effective wavelength $\lambda_1$ corresponding to the center frequency of the frequency band of operation, and the first width (W1') equal to 0.5 mm.

12. The antenna system, according to claim 1, wherein the frequency band of operation is within one of these ranges: 1.5-1.6 GHz; 2.4-2.5 GHz; 3.5-3.6 GHz; 3.6-3.7 GHz; 4.9-5.8 GHz; 5.8-6.0 GHz.

13. A motor vehicle comprising a front window and an antenna system according to claim 1, wherein the reflector plane of said antenna system is disposed substantially orthogonal to the ground.

14. The motor vehicle according to claim 13, wherein the antenna system is disposed in one of the vehicle locations of the group that comprises: the front window area, the backlite area, a front or rear bumper, a spoiler, a fender, a decklid, a dashboard, an interior mirror, an exterior mirror, and a rear-brake light.

15. The motor vehicle with an antenna system according to claim 1, wherein the second antenna device is a monopole antenna device disposed on the roof of the rear end of the vehicle and connected to the first antenna device by cable means.

16. The motor vehicle according to claim 13, with a receiver configured for processing radio signals, wherein said receiver is configured for processing the signals received by the antenna system and wherein said antenna system is contained within a package that additionally includes the receiver.

17. The motor vehicle according to claim 13, with a receiver having a front-end part and being configured for processing radio signals, wherein said receiver is configured for processing the signals received by the antenna system and wherein said antenna system is contained within a package that, at least, additionally includes the front-end of the receiver.

18. The motor vehicle according to claim 13, with a receiver configured for processing radio signals, wherein the antenna system is located over a printed circuit board where the receiver is placed.

* * * * *